US005163524A

United States Patent [19]

Newton, Jr. et al.

[11] Patent Number: 5,163,524

[45] Date of Patent: Nov. 17, 1992

[54] ROTARY DRILL BITS

[75] Inventors: Thomas A. Newton, Jr., Harris County, Tex.; John M. Clegg, Redland, England

[73] Assignee: Camco Drilling Group Ltd., Houston, Tex.

[21] Appl. No.: 785,543

[22] Filed: Oct. 31, 1991

[51] Int. Cl.[5] ..... E21B 10/46

[52] U.S. Cl. ..... 175/408; 175/426

[58] Field of Search ..... 175/327, 374, 425, 426, 175/408

[56] References Cited

U.S. PATENT DOCUMENTS 5,042,596 8/1991 Brett et al. ..... 175/408 X 5,111,895 5/1992 Griffin ..... 175/426 X

*Primary Examiner*—William P. Neuder

[57] ABSTRACT

A rotary drill bit comprises a bit body carrying a plurality of preform cutting elements, and a plurality of circumferentially spaced gauge pads which, in use, engage the surrounding formation. Some of the gauge pads carry cutting elements and others are free of cutting elements. To reduce cost, each gauge pad which is free of cutting elements has an outer bearing surface which is more abrasion resistant than the outer surfaces of the gauge pads which carry cutting elements.

9 Claims, 3 Drawing Sheets

FIG 3
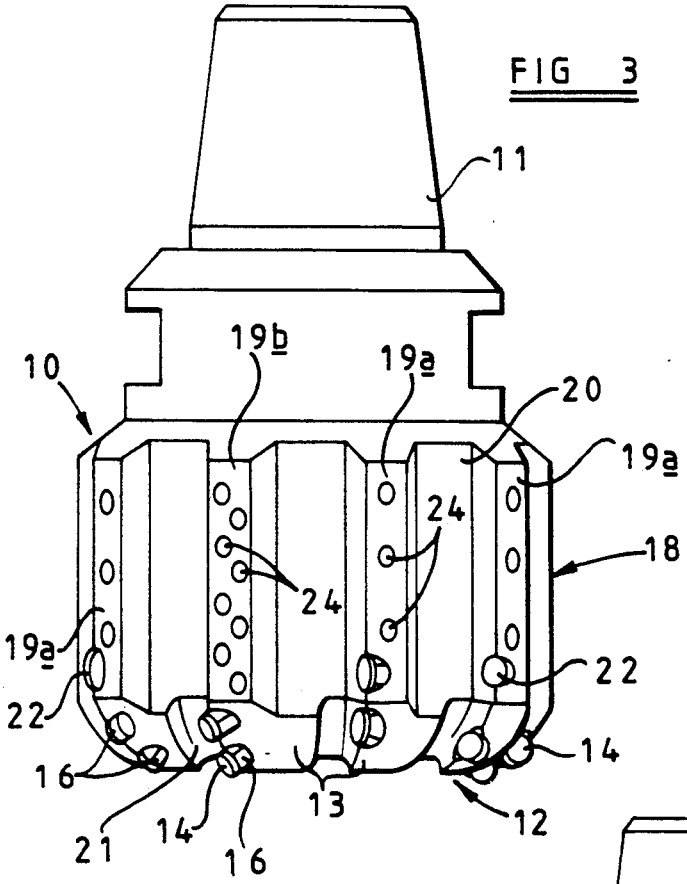
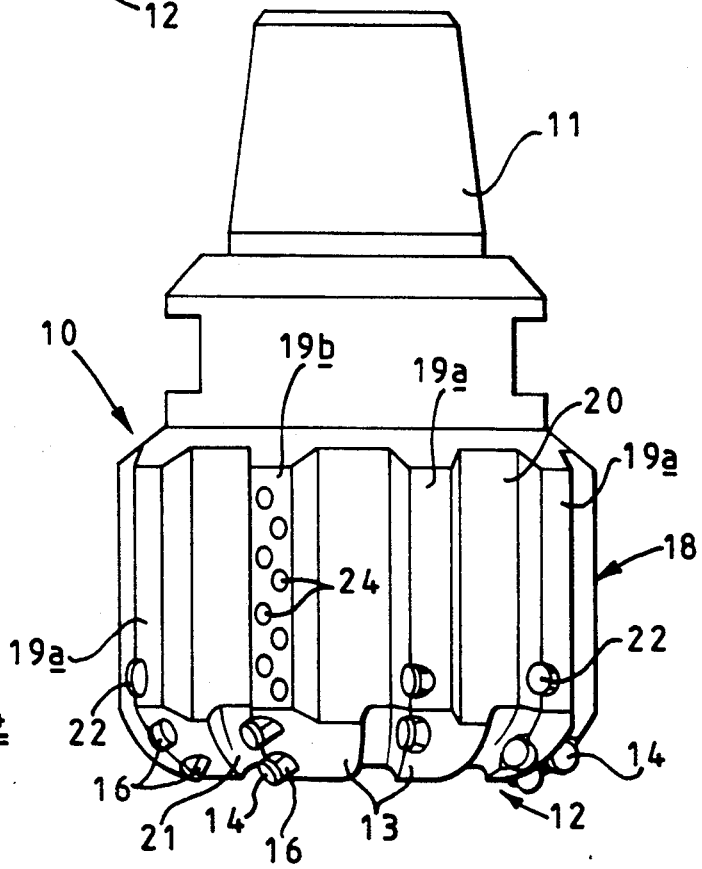
FIG 4

ROTARY DRILL BITS

BACKGROUND OF THE INVENTION

The invention relates to rotary drill bits for use in drilling or coring holes in subsurface formations, and particularly to polycrystalline diamond compact (PDC) drag bits.

Rotary bits of the kind to which the present invention relates comprise a bit body having a shank for connection to a drill string and a passage for supplying drilling fluid to the face of the bit, which carries a plurality of preform cutting elements each formed at least in part from polycrystalline diamond, the gauge of the bit including a plurality of circumferentially spaced gauge pads which, in use, engage the surrounding formation forming the walls of the bore hole being drilled.

One common form of cutting element comprises a tablet, usually circular or part-circular, made up of a table of polycrystalline diamond, providing the front cutting face of the element, bonded to a substrate of less hard material, usually cemented tungsten carbide.

The bit body may be machined from solid metal, usually steel, or may be moulded using a powder metallurgy process in which tungsten carbide powder is infiltrated with metal alloy binder in furnace so as to form a hard matrix.

Normally the majority of the cutting elements are mounted on a downwardly-facing end face of the bit body. However, some cutting elements, known as gauge cutters, may be mounted on certain of the gauge pads, such gauge cutters then determining the diameter of the bore hole being drilled. Commonly, cutting elements are mounted on only some of the gauge pads, certain of the gauge pads being free of cutting elements.

The gauge pads are subject to abrasion as the bit rotates in the borehole, and it is therefore normally considered necessary to provide some form of abrasion-resistant means on the gauge pads, for example in the form of abrasion resistant inserts or an abrasion resistant surface. However, the necessity of increasing the abrasion resistance of the gauge pads increases the cost of the bit, not only due to the cost of the abrasion resistant materials, but also due to the cost of the manufacturing process of applying such materials on the gauge pads. Generally speaking, the cost of rendering the gauge pads more abrasion resistant increases with the degree of abrasion resistance required.

Hitherto, it has been considered necessary to provide all the gauge pads of the drill bit with the same abrasion resistant means. According to the present invention, however, different forms of abrasion resistance are applied to different gauge pads of the drill bit, in a manner to reduce the overall cost of manufacture of the drill bit.

SUMMARY OF THE INVENTION

According to the invention there is provided a rotary drill bit comprising a bit body having a shank for connection to a drill string and means for supplying drilling fluid to the face of the bit, which carries a plurality of preform cutting elements each formed at least in part from polycrystalline diamond, the gauge of the bit including a plurality of circumferentially spaced gauge pads which, in use, engage the surrounding formation forming the walls of the borehole being drilled, some of said gauge pads carrying cutting elements and others of said gauge pads being free of cutting elements, and each said gauge pad which is free of cutting elements having an outer bearing surface which is more abrasion resistant than the outer surfaces of the gauge pads carrying cutting elements.

In one embodiment at least the outer surface of each gauge pad free of cutting elements is formed from solidified matrix material formed by a powder metallurgy process, and the outer surface of each gauge pad carrying cutting elements is formed from steel. Alternatively, the outer surface of each gauge pad free of cutting elements may have a smooth thin layer of polycrystalline diamond applied thereto by chemical vapor deposition.

In another embodiment the outer surfaces of the gauge pads have abrasion-resistant inserts mounted therein, and the gauge pads carrying cutting elements have fewer inserts mounted therein than the gauge pads which are free of cutting elements, or have no inserts at all.

Alternatively, the inserts in the gauge pads which are free of cutting elements may be each more abrasion-resistant than the inserts in the gauge pads which carry cutting elements.

In any of the above arrangements the inserts may comprise bodies of material selected from: natural diamond, synthetic diamond, thermally stable polycrystalline diamond, and tungsten carbide.

BRIEF DESCRIPTION OF THE DRAWINGS

FIGS. 3, 4 and 5 are side elevations, similar to FIG. 1, of alternative forms of drill bit in accordance with the invention.

DETAILED DESCRIPTION OF THE PREFERRED EMBODIMENTS

Figure 1:
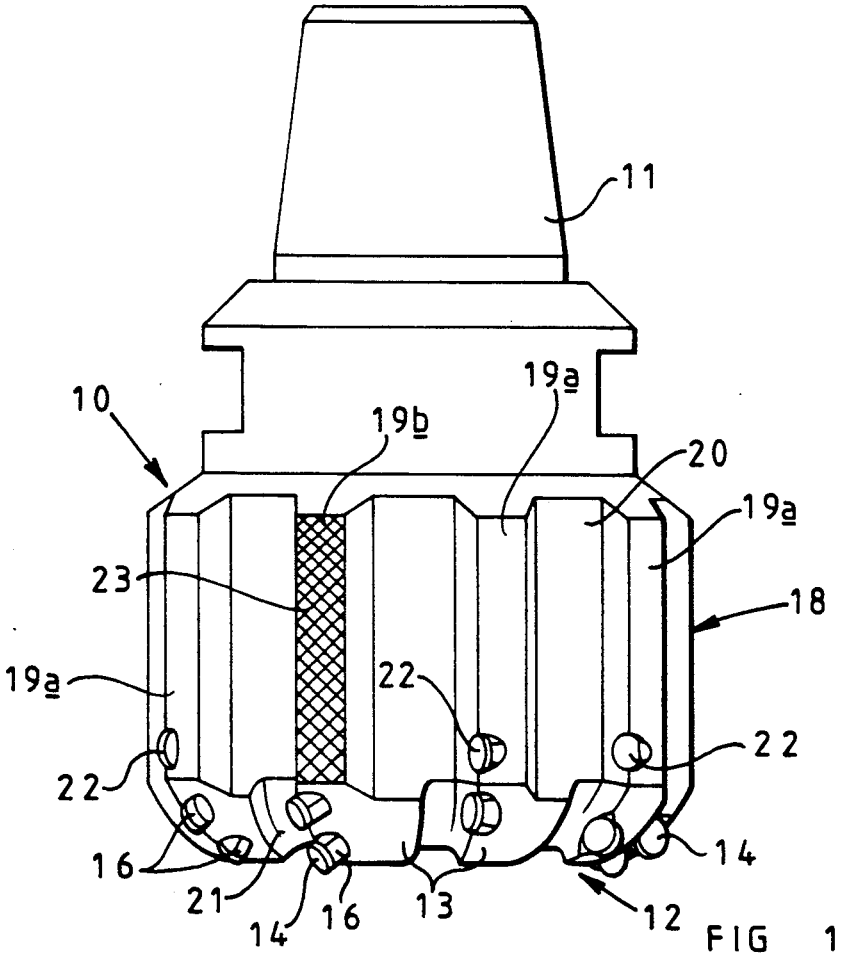
FIG. 1 is a diagrammatic side elevation of a rotary drill bit in accordance with the present invention.
Figure 2:
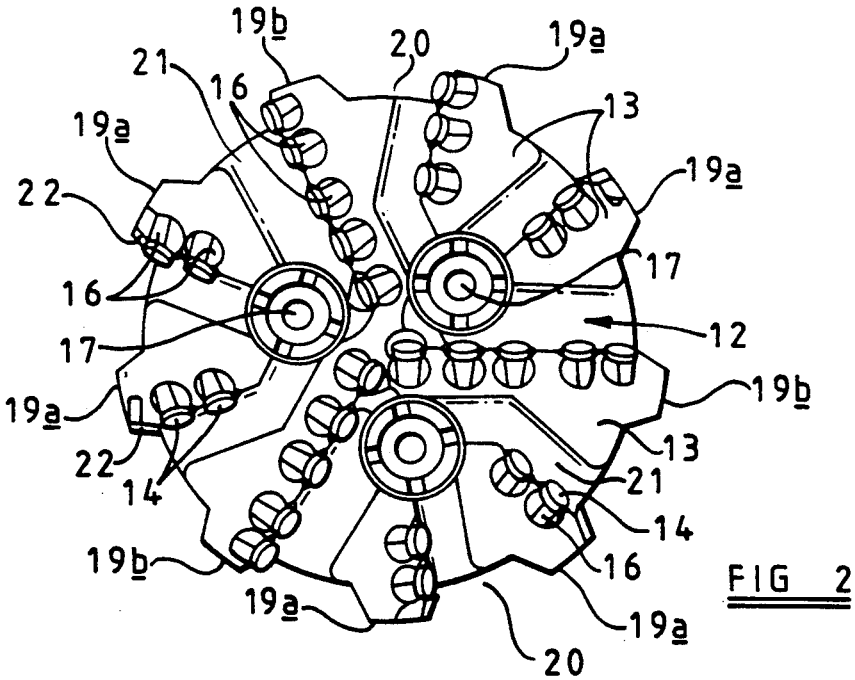
FIG. 2 is a bottom end view of the bit shown in FIG. 1.

Referring to FIGS. 1 and 2: the drag-type drill bit comprises a bit body 10 having a shank 11 for connection to a drill string.

The lower end face 12 of the bit body 10 is formed with a number of blades 13 (in this case nine blades) extending outwardly away from the central axis of rotation of the drill bit. Spaced apart side-by-side along each blade 13 are a plurality of cutting elements 14. Each cutting element 14 is circular and comprises a thin cutting table of polycrystalline diamond bonded to a thicker substrate of cemented tungsten carbide. The tungsten carbide substrate is brazed to a stud-like carrier 16 which is received and retained in a socket in the bit body.

The bit body is provided with a central passage (not shown) which communicates through internal bores with nozzles 17 in the face of the bit, the flow of drilling fluid from the nozzles 17 serving to cool and clean the cutting elements 14 during operation of the bit.

The bit body includes a gauge portion, indicated generally at 18, which comprises a plurality of gauge pads 19*a* and 19*b* extend along the gauge portion 18 of the bit body in a direction substantially parallel to the central longitudinal axis of the bit. The gauge pads are spaced apart circumferentially of the bit and are separated by junk slots 20 which are in communication with channels 21 between the blades 13. During drilling, fluid emerging from the nozzles 17 flows outwardly along the channels 21 and upwardly through the junk slots 20, in known manner.

The majority of the cutting elements 14 are mounted on the blades 13 on the lower end face 12 of the bit body. However, certain of the gauge pads also have cutting elements 22 mounted on them at the lower ends of the gauge pads, adjacent the outer periphery of the end face 12 of the bit. The cutting elements 22 on the gauge pads are of similar construction to the end face cutting elements 14 and are known as gauge cutters.

In the arrangement shown in FIGS. 1 and 2 every third gauge pad, around the periphery of the drill bit, is free of gauge cutters 22. The gauge pads which carry gauge cutter 22 are referenced 19*a* and the gauge pads which are free of gauge cutters are referenced 19*b*.

The body 10 of the bit shown in the drawings is typically machined from steel, although as previously mentioned the bit body may also be moulded from solidified matrix material using a powdered metallurgy process. In either case, it is normally considered necessary to provide abrasion resistant means on the outwardly facing surfaces of the gauge pads 19*a* and 19*b* to prevent excessive wear of the surfaces of the gauge pads. Hitherto, the usual practice has been for all the gauge pads to be treated in the same way and various methods have been employed for rendering the gauge pads more abrasion resistant.

Typically, abrasion resistance may be provided by applying a hard facing layer to the surface of each gauge pad, or mounting a plurality of cylindrical inserts in each pad, the outer surface of each insert being substantially flush with surface of the pad.

According to the present invention the gauge pads 19*b* which are free of gauge cutters 22 are rendered more abrasion resistant than the gauge pads 19*a* on which gauge cutters 22 are provided.

For example, in the arrangement of FIG. 1 each gauge pad 19*b* may be formed with a smooth hard facing layer of abrasion resistant material, as indicated at 23, the gauge pads 19*a*, which carry gauge cutters 22, being free of such abrasion resistant material or being faced with a material which is less abrasion resistant than the layer 23.

The abrasion resistant layer 23 may comprise a layer of solidified matrix material applied to the steel of the bit body, in which case each gauge pad 19*a* may be free of any such layer, and may simply comprise the steel from which the bit body is formed. Alternatively, the layer 23 might comprise a layer of polycrystalline diamond formed by chemical vapor deposition, each gauge pad 19*a* again being uncoated steel or being coated with a layer of material which is less abrasion resistant than the polycrystalline diamond, such as solidified matrix or other hard facing material.

Figure 5:
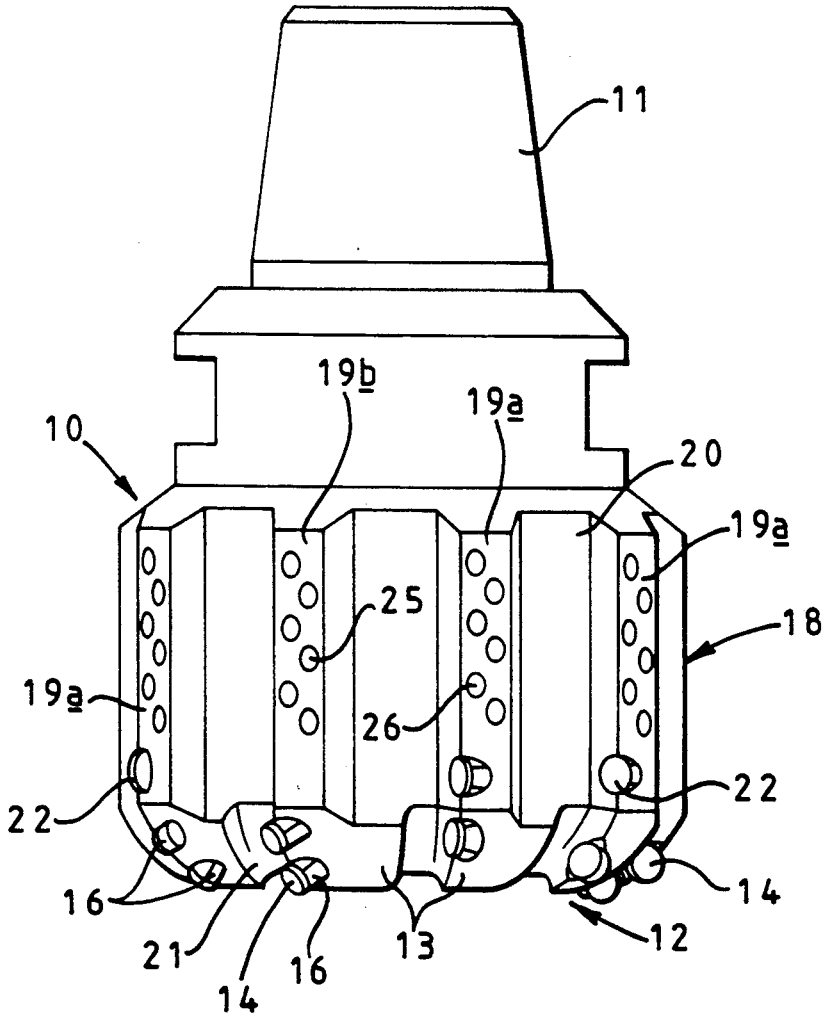

FIGS. 3, 4 and 5 show modified versions of the drill bit shown in FIGS. 1 and 2 and corresponding parts bear the same reference numerals.

In the drill bit of FIG. 3 each gauge pad is rendered abrasion resistant by mounting a plurality of inserts 24 in the gauge pad. Such inserts are in the form of cylindrical studs of circular cross-section received in sockets in the gauge pads so that the outer surfaces of the studs are substantially flush with the outer surface of the gauge pad. Each insert may be formed from cemented tungsten carbide or other hard, abrasion resistant material, or from tungsten carbide in which particles of natural or synthetic diamond, or other superhard material, are embedded.

In the bit body of FIG. 3 the gauge pads 19*b* which are free of gauge cutters 22 are rendered more abrasion resistant than the gauge pads 19*a*, which carry such gauge cutters, by providing the gauge pads 19*b* with more inserts than the gauge pads 19*a*.

FIG. 4 shows an extreme version of this principle where no inserts at all are provided in the gauge pads 19*a* on which gauge cutters 22 are provided.

FIG. 5 shows a further alternative arrangement in which a similar number of abrasion resistant inserts are provided on both the gauge pads 19*a* and the gauge pads 19*b*. In this case, however, each insert 25 on a gauge pad 19*b* is individually more abrasion resistant than a corresponding insert 26 on a gauge pad 19*a*. For example, the inserts 25 may comprise diamond particles embedded in tungsten carbide studs, whereas the inserts 26 may comprise plain tungsten carbide studs.

It will be appreciated that other combinations of abrasion resistant and less abrasion resistant materials and means may be employed to achieve the same effect. Thus, the diamond layer 23 on the gauge pads 19*b*, in the arrangement of FIG. 1, may be combined with inserts of diamond or tungsten carbide in the gauge pads 19*a*, or indeed with virtually any other form of abrasion resistance on the gauge pads 19*a* since a layer of polycrystalline diamond will provide the most abrasion resistant form of layer which is commonly available.

In all of the arrangements described above the cost of providing the less abrasion resistant means on each pad 19*a* will normally be less than the cost of providing the means of greater abrasion resistance on each pad 19*b*. Accordingly, by limiting the highest abrasion resistance to those gauge pads where it is most needed, i.e. those which are not provided with gauge cutters 22, the overall cost of manufacture of the drill bit may be reduced, without compromising the effectiveness of the bit, when compared with prior art drill bits in which all the gauge pads are rendered similarly abrasion resistant.

The invention is particularly applicable to so-called "anti-whirl" drill bits in which the bit is so designed that a lateral imbalance force is applied to the bit as it rotates in use, a number of gauge pads free of cutting elements being so located on one side of the bit as to transmit the lateral imbalance force to the part of the formation which the gauge pads are for the time being engaging. Such arrangement tends to inhibit the initiation of bit whirl, since the pads without gauge cutters tend to slide across the surface of the formation instead of trying to "walk" around the borehole in the opposite direction to the direction of rotation of the bit.

In such a drill bit these gauge pads are more subject to wear than gauge pads on other parts of the bit body and, in accordance with the present invention, the overall cost of such a drill bit may be reduced by limiting the application of highly abrasion resistant means to those gauge pads.

We claim:

1. A rotary drill bit comprising a bit body having a shank for connection to a drill string and means for supplying drilling fluid to the face of the bit, which carries a plurality of preform cutting elements each formed at least in part from polycrystalline diamond, the gauge of the bit including a plurality of circumferentially spaced gauge pads which, in use, engage the surrounding formation forming the walls of the borehole being drilled, some of said gauge pads carrying cutting elements and others of said gauge pads being free of cutting elements, and each said gauge pad which is free of cutting elements having an outer bearing surface which is more abrasion resistant than the outer surfaces of the gauge pads carrying cutting elements.

2. A rotary drill bit according to claim 1, wherein at least the outer surface of each gauge pad free of cutting elements is formed from solidified matrix material formed by a powder metallurgy process, and the outer surface of each gauge pad carrying cutting elements is formed from steel.

3. A rotary drill bit according to claim 1, wherein the outer surface of each gauge pad free of cutting elements has a smooth thin layer of polycrystalline diamond applied thereto by chemical vapor deposition.

4. A rotary drill bit according to claim 1, wherein the outer surfaces of the gauge pads have abrasion-resistant inserts mounted therein, and the gauge pads carrying cutting elements have fewer inserts mounted therein than the gauge pads which are free of cutting elements.

5. A rotary drill bit according to claim 4, wherein said inserts comprise bodies of material selected from: natural diamond, synthetic diamond, thermally stable polycrystalline diamond, and tungsten carbide.

6. A rotary drill bit according to claim 1, wherein the outer surfaces of the gauge pads have abrasion-resistant inserts mounted therein, and the inserts in the gauge pads which are free of cutting elements are each more abrasion-resistant than the inserts in the gauge pads which carry cutting elements.

7. A rotary drill bit according to claim 6, wherein said inserts comprise bodies of material selected from: natural diamond, synthetic diamond, thermally stable polycrystalline diamond, and tungsten carbide.

8. A rotary drill bit according to claim 1, wherein the outer surfaces of the gauge pads which are free of cutting elements have abrasion-resistant inserts mounted therein, and the gauge pads carrying cutting elements are substantially free of such inserts.

9. A rotary drill bit according to claim 8, wherein said inserts comprise bodies of material selected from: natural diamond, synthetic diamond, thermally stable polycrystalline diamond, and tungsten carbide.

* * * * *